United States Patent [19]

Hattori

[11] Patent Number: 5,064,203

[45] Date of Patent: Nov. 12, 1991

[54] TENNIS RACKET

[76] Inventor: Shuhei Hattori, Parasuto Kamikitazawa 305, 1-39-15 Shimo-Takaido, Suginami-ku, Tokyo, Japan

[21] Appl. No.: 643,082

[22] Filed: Jan. 22, 1991

Related U.S. Application Data

[63] Continuation of Ser. No. 241,474, Sep. 7, 1988, abandoned.

[51] Int. Cl.[5] ..... A63B 49/08

[52] U.S. Cl. ..... 273/73 J; 273/75; 273/81 B

[58] Field of Search ..... 273/73 R, 73 J, 75, 273/81 B

[56] References Cited

U.S. PATENT DOCUMENTS

| | | | |
|---|---|---|---|
| 1,912,942 | 6/1933 | Kleinman | 273/75 |
| 2,655,963 | 10/1953 | Dell | 273/75 X |
| 3,706,453 | 12/1972 | Rosasco, Jr. | 273/81 B X |

FOREIGN PATENT DOCUMENTS

| | | | |
|---|---|---|---|
| 3312927 | 10/1984 | Fed. Rep. of Germany | 273/75 |
| 62-149363 | 9/1987 | Japan | 273/75 |
| 474058 | 10/1937 | United Kingdom | 273/81 B |

*Primary Examiner*—Edward M. Coven
*Assistant Examiner*—Raleigh W. Chiu
*Attorney, Agent, or Firm*—Oblon, Spivak, McClelland, Maier & Neustadt

[57] ABSTRACT

A tennis racket has its grip portion provided with a raised portion which extends over substantially the entire length of the grip portion.

7 Claims, 2 Drawing Sheets

TENNIS RACKET

This application is a continuation of Ser. No. 241,474, filed 9/7/88, now abandoned.

BACKGROUND OF THE INVENTION

1. Field of the Invention

This invention relates to an improvement on the grip of a tennis racket.

2. Prior Art Statement

The most popular way of holding the grip of a tennis racket is by the so-called "Eastern grip". When the racket is held in the right hand to hit a ball with a forehand stroke, the grip is held by the hand with the face of the racket first held vertically and then the hand is slightly turned rightwardly (FIG. 1). In contrast, when the ball is hit with a backhand stroke, the grip is held with the hand turned leftwardly by about 1 to 2 cm (FIG. 2) from the forehand position.

A tennis racket provided with a projection on the outer peripheral surface of the grip portion is disclosed in Japanese Utility Model Public Disclosure No. SHO 55-628.

The projection formed on the grip portion of the conventional racket is provided for the following reasons. Since the sectional configuration of the grip portion is circular or elliptical, the grip, when held in the hand, slips and turns easily in the hand. Therefore, if the grip is held in hand with the thumb and index finger caught on the projection, the grip portion is prevented from turning in the hand. However, the structure of the grip portion of the conventional racket is not appropriate for beginners because they cannot quickly decide how far the hand should be turned from the current position on the grip portion to enable hitting the ball in the best way when it returns to him from the other player. Therefore, the beginner is apt to make mistakes with the conventional racket. The result is that his progress is slow.

OBJECT AND SUMMARY OF THE INVENTION

The object of the present invention is to provide a tennis racket, in which the most suitable angle of the racket face with respect to the ball can be tactilely determined by the palm without looking at the racket.

In order to achieve the above object, a tennis racket according to the present invention has a grip portion provided with a raised portion extending over the entire length thereof in the longitudinal direction.

Because of a provision of the raised portion on the grip portion, the player learns the best way for holding the grip which is not only applicable to a forehand stroke but also to a backhand stroke. The reason is that he immediately learns which part of the palm feels the raised portion when he holds the grip portion with the forehand stroke or with the backhand stroke. Therefore, he can hit the ball back in the best way.

This is also true to the English grip and the Western grip. That is, the player physically learns which part of the palm should feel the raised portion when he holds the grip portion correctly. Therefore, he can easily hold the grip portion correctly without looking at the grip.

The above and other objects and features of the invention will become more apparent from the following detailed description with reference to the accompanying drawings.

BRIEF DESCRIPTION OF THE DRAWINGS

FIG. 8 is a perspective view illustratign a tube having a pair of raised ribs formed on the outer surface.

DETAILED DESCRIPTION OF THE PREFERRED EMBODIMENT

Figure 1:
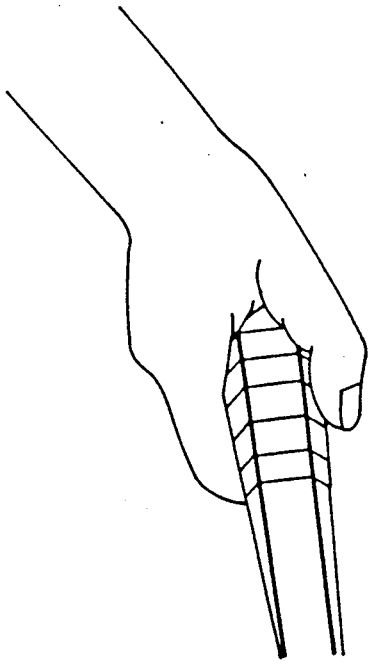
FIG. 1 is a perspective view showing the Eastern grip for a forehand stroke.
Figure 2:
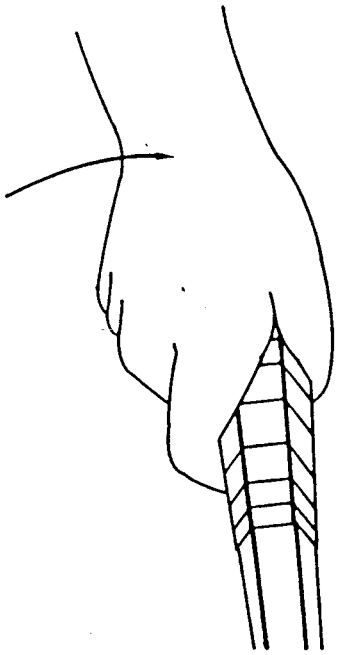
FIG. 2 is a perspective view showing the Eastern grip for a backhand stroke.
Figure 3:
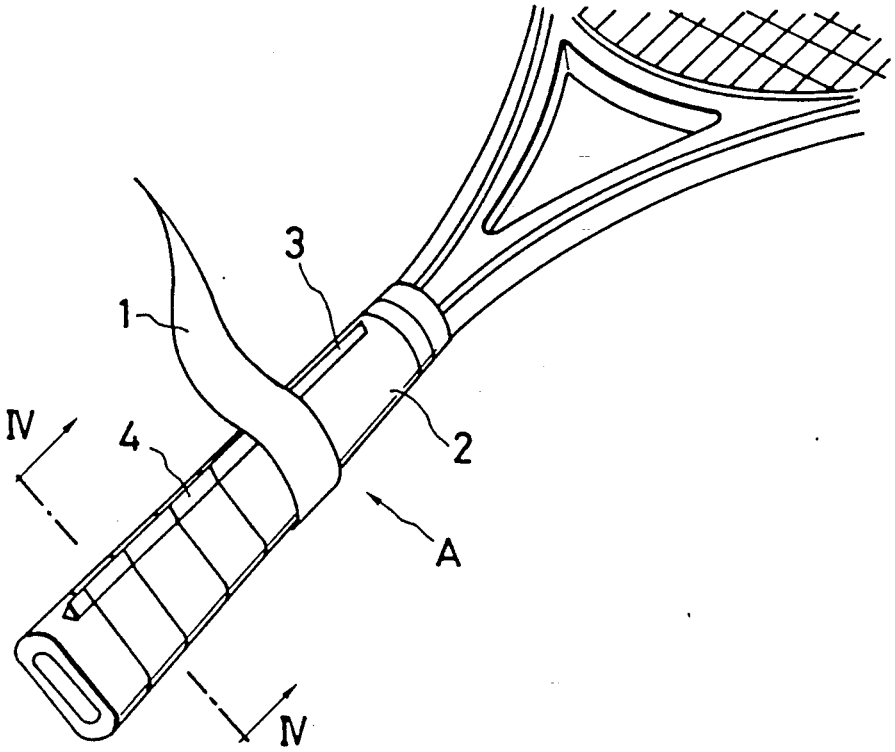
FIG. 3 is a perspective view showing one embodiment of a grip of a tennis racket according to the present invention, wherein the grip is provided with a leather tape wound therearound.
Figure 4:
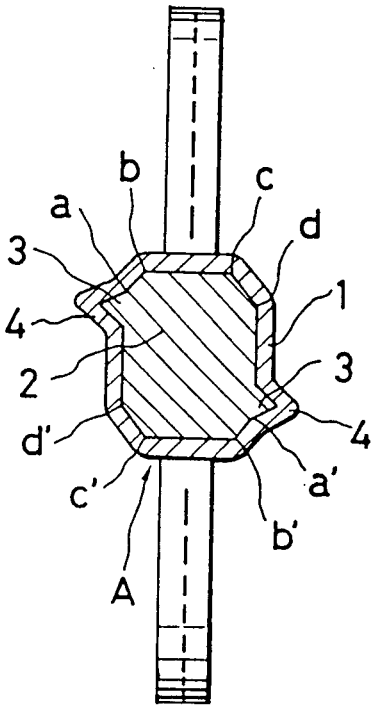
FIG. 4 is a sectional view taken along line IV—IV of FIG. 3.

In the embodiment of FIGS. 3 and 4, a core member 2 of a grip portion A is provided with one or more raised ribs 3 over generally the entire length thereof. By winding a leather tape around the grip portion A which is provided with the raised rib 3 and attaching the leather tape thereto by a suitable adhesive agent, a raised portion 4 comprising the raised rib 3 is formed over generally the entire length of the grip portion A.

In this embodiment, the core member 2 has a somewhat slender octagonal configuration in section, which is the most popular shape. However, the sectional shape of the core member 2 may be circular, elliptical or any of many other shapes.

The raised rib 3 may be integral with the core member 2. Otherwise, the raised rib 3 may be made of a suitable material such as synthetic resin, rubber, metal or wood, and then it may be attached to the core member 2 by suitable adhesive agent. Similarly, the sectional shape of the raised rib 3 may take any of many other configurations and may, for example, be semicircular or polygonal. In the illustrated embodiment, it is triangular with a rounded top. A single raised rib 3 suffices. In the illustrated embodiment, two raised ribs 3 are provided along ridges a and a' at diagonally opposite positions. Alternatively, the raised ribs 3 may be provided along other ridges b and b' or may be provided along the slanted sides between the ridges a and b and between the ridges a' and b'.

The raised ribs 3 are preferably provided along the ridges a and a' or along the ridges b and b', or between the ridges a and b and between the ridges a' and b' for the following reasons. When the grip portion is held in the hand, the raised portion 4 formed on the outer surface of the grip portion along the ridge a or b generally contacts the part of the hand between the thumb and index finger, whereas the raised portion 4 formed on the outer surface of the grip portion along the ridge a' or b' contacts the joint portions of the four fingers other than the thumb. Therefore, the player can easily learn the proper feel of the contact. Moreover, the grip portion is effectively prevented from turning in the hand.

When the grip portion is held by the right hand in a forehand style in Eastern grip, the raised portion 4 formed along the ridge a' or b' contacts, for example, the joints of the roots of the four fingers other than the thumb. When the way of holding the grip is changed to the backhand style, the raised portion 4 contacts the second joints of the four fingers. By learning the feel of this contact, the player is able to learn to change correctly from the forehand style to the backhand style and vice versa.

To obtain a racket suitable for a left-handed player, the raised rib 3 can be provided along the ridges c and c' or along the ridges d, d', or between the ridges c and d and between the ridges c' and d'.

Figure 5:
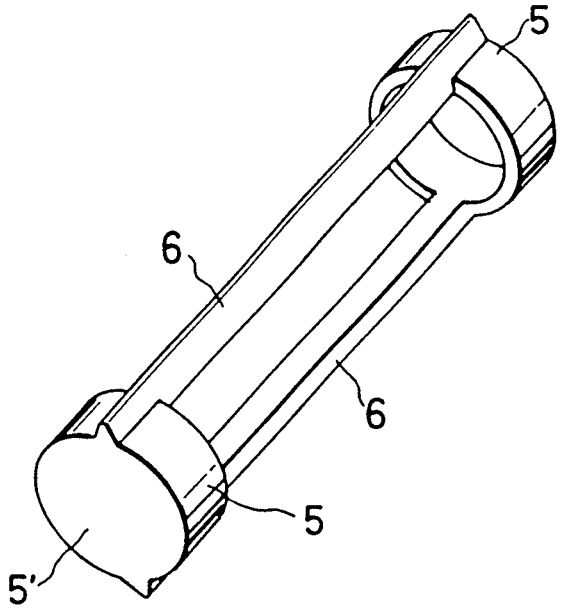
FIG. 5 is a perspective view showing one embodiment of a member for providing a raised portion on the racket grip according to the present invention.
Figure 6:
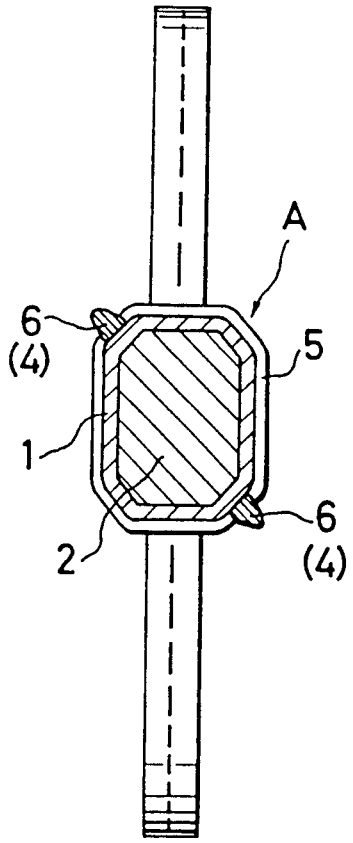
FIG. 6 is a sectional view of a grip portion of a racket comprising the member of FIG. 5.

In the embodiment of FIGS. 5 and 6, two elastic ring members 5 are connected with each other by one or two rod-shaped connecting members 6. As one example, the ring member 5 is spread and then fitted on the core member 2 of the grip portion, and then a leather tape 1 is wound thereon and the raised portion 4 is formed by the rodshaped connecting member 6. As another example, the spread ring 5 is fitted on the grip portion with the leather tape wound therearound, and the rod-shaped connecting member 6 itself serves as the raised portion 4 as shown in FIG. 6. One of the two rings 5 may be blocked with an end wall 5' to form a cap shape, and the resultant may be put on the rear end of the grip portion.

Figure 7:
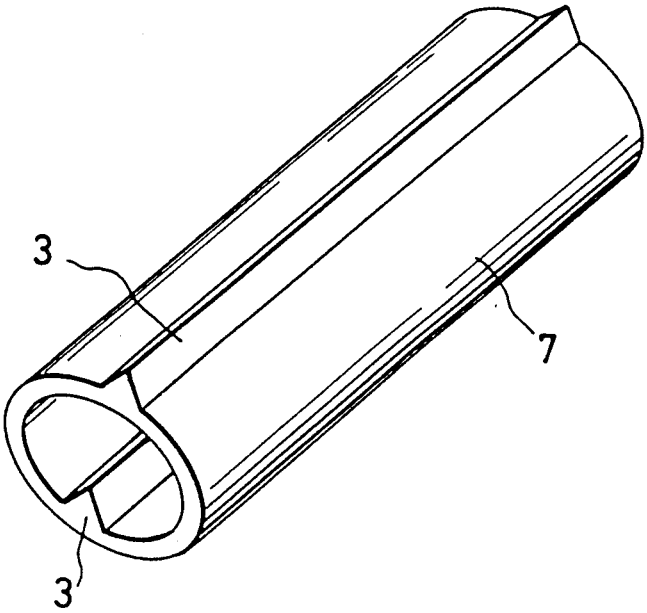
FIG. 7 is a perspective view showing another embodiment of the member for providing a raised portion on the racket grip according to the present invention.

In the embodiment of FIG. 7, the raised rib 3 is provided on the inner surface and the outer surface of a thermal contractive tube 7. As with the embodiment illustrated in FIGS. 5 and 6, the tube 7 is fitted over the core member 2 of the grip portion or over the leather tape 1 wound therearound and secured thereto by contracting the tube by heating. Where the tube 7 is secured directly on the core member 2, the leather tape 1 is wound on the tube 7. By the thermal contraction, the raised rib 3 formed on the outer surface of the tube 7 serves as the raised portion 4 and the raised rib 3 formed on the inner surface of the tube 7 forms, in conjunction with the surface of the core 2 or the leather tape 1 wound therearound, a raised portion 6 on the corresponding outer surface of the tube 7. In the illustrated embodiment, one raised rib 3 for forming the raised portion 4 is integrally provided on the inner surface of the tube 7, whereas the other raised rib 3 is integrally provided on the outer surface thereof. However, both the raised ribs 3 may be provided on the inner surface or the outer surface of the tube. FIG. 8 shows the raised ribs on the outer surface. In the embodiment of FIGS. 5 and 6, the raised portions 4 can be secured to the core member of the grip portion or onto the leather tape wound therearound, by the elastic force of the rings 5. Similarly, in the embodiment of FIG. 7, the raised ribs 3 tube 7. Particularly, when the raised ribs 3 are secured onto the leather tape, the time and labor for winding the leather tape thereon can be saved, and the purchaser can easily mount it on his racket himself. Moreover, he can adjust the position of the rod-shaped connecting member 6 or the raised portion 3 in the desired direction on the grip portion depending on whether the player is righthanded or left-handed.

As is apparent from the foregoing description, according to the present invention, the correct way of holding the grip by the Eastern grip in a forehand style and in a backhand style can be easily determined by feeling which part of the palm is in contact with the raised portion provided over generally the entire length of the grip portion. Thus, a tennis racket according to the present invention is of great help for improving one's tennis playing skill rapidly.

Moreover, the grip portion is effectively prevented from turning in the palm of the hand. This is not only true of the Eastern grip but also of the other grips such as the English grip or Western grip.

What is claimed is:

1. A grip portion of a tennis racket to be held by a user's hand, wherein said grip portion comprises:

only two raised ribs which are disposed along ridges at diagonally opposite portions of a cross section of said grip portion and extend over generally the entire length of said grip portion, wherein said grip portion is firmly held in said hand in a gripping position that remains the same during a forehand stroke and a backhand stroke, thereby enabling the user to determine and maintain an optimum grip which is applicable in both said forehand stroke and said backhand stroke, and said raised ribs prevent rotation of said racket within said hand.

2. Grip portion of claim 1, wherein each of said raised ribs is provided on an outer peripheral surface of a core member of said grip portion in the longitudinal direction; and a leather tape is wound around said raised ribs.

3. Grip portion of claim 1, wherein each of said raised ribs is provided at each end thereof with an elastic ring member, said ring member being fitted on said grip portion, thereby forming said raised ribs on said grip portion.

4. Grip portion of claim 1, wherein a tube provided on an outer surface thereof with said two raised ribs in the longitudinal direction is fitted onto said grip portion, thereby forming said raised ribs on said grip portion.

5. A tennis racket of claim 4, wherein said tube is thermally contractible.

6. A grip portion of a tennis racket to be held by a user's hand, wherein said grip portion comprises:

only two raised ribs which extend over generally the entire length of said grip portion and are disposed at positions where one of said two raised ribs comes into contact with the part of the hand between the thumb and the index finger and the other raised rib comes into contact with the joint portions of the four fingers other than the thumb when said grip portion is held in the hand, wherein said grip portion is firmly held in said hand in a gripping position that remains the same during a forehand stroke or a backhand stroke, thereby enabling the user to determine and maintain an optimum grip which is applicable in both said forehand stroke and said backhand stroke, and said raised ribs prevent rotation of said racket within said hand.

7. A grip portion of a tennis racket to be held be a user's hand, wherein said grip portion comprises:

only two raised ribs which extend over generally the entire length of said grip portion and are disposed at diagonally opposite positions, wherein one of said two raised ribs comes into contact with the part of the hand between the thumb and the index finger at all times, and the other raised rib comes into contact with the joint portions of the four fingers other than the thumb at all times when said grip portion is held in the hand, and wherein said grip portion is firmly held in asid hand in a grippin position that remains the same during a forehand stroke or a backhand stroke, thereby enabling the user to determine and maintain an optimum grip which is applicable in both said forehand stroke and said backhand stroke, and said raised ribs prevent rotation of said racket within said hand.

* * * * *